US010099478B2

(12) United States Patent
Ohnishi et al.

(10) Patent No.: US 10,099,478 B2
(45) Date of Patent: Oct. 16, 2018

(54) LIQUID DISCHARGE APPARATUS INCLUDING WIPER TO WIPE SURFACE OF NOZZLE PLATE BOTH IN FORWARD DIRECTION AND IN OPPOSITE DIRECTION

(71) Applicants: Masashi Ohnishi, Kanagawa (JP); Shotaro Takeuchi, Kanagawa (JP)

(72) Inventors: Masashi Ohnishi, Kanagawa (JP); Shotaro Takeuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/428,567

(22) Filed: Feb. 9, 2017

(65) Prior Publication Data

US 2017/0253044 A1 Sep. 7, 2017

(30) Foreign Application Priority Data

Mar. 1, 2016 (JP) ..... 2016-039387

(51) Int. Cl.
*B41J 2/165* (2006.01)

(52) U.S. Cl.
CPC ..... *B41J 2/16535* (2013.01); *B41J 2/16505* (2013.01)

(58) Field of Classification Search
CPC ..... B41J 2/16535; B41J 2/16505
See application file for complete search history.

(56) References Cited

U.S. PATENT DOCUMENTS

2007/0046724 A1* 3/2007 Jung ..... B41J 2/16535 347/33
2009/0315943 A1 12/2009 Ohnishi et al.
2010/0165040 A1 7/2010 Ohnishi et al.
2013/0002756 A1* 1/2013 Kriz ..... B41J 2/16538 347/33
2017/0096008 A1* 4/2017 Nakagawa ..... B41J 2/16535

FOREIGN PATENT DOCUMENTS

JP 2005-104143 4/2005
JP 2013-169761 9/2013
JP 2013-173244 9/2013
JP 2013-173245 9/2013
JP 2014-000704 1/2014
JP 2014-162135 9/2014

* cited by examiner

*Primary Examiner* — Bradley Thies
(74) *Attorney, Agent, or Firm* — Cooper & Dunham LLP

(57) ABSTRACT

A liquid discharge apparatus is provided including a liquid discharge head, a cap, and a wiper. The liquid discharge head includes a nozzle plate having thereon a nozzle for discharging a liquid. The cap caps a surface of the nozzle plate. The wiper moves relative to the nozzle plate to wipe the surface of the nozzle plate. The surface of the nozzle plate has a cap contact region that is contactable with the cap. The wiper starts wiping from a wiping start position that is disposed between both end parts of the cap contact region in a direction of wiping. The wiper comes into contact with the surface of the nozzle plate at the wiping start position and moves in a first direction to wipe the surface of the nozzle plate, and thereafter moves in a second direction opposite the first direction to wipe the surface of the nozzle plate.

15 Claims, 14 Drawing Sheets

LIQUID DISCHARGE APPARATUS INCLUDING WIPER TO WIPE SURFACE OF NOZZLE PLATE BOTH IN FORWARD DIRECTION AND IN OPPOSITE DIRECTION

CROSS-REFERENCE TO RELATED APPLICATIONS

This patent application is based on and claims priority pursuant to 35 U.S.C. § 119(a) to Japanese Patent Application No. 2016-039387, filed on Mar. 1, 2016, in the Japan Patent Office, the entire disclosure of which is hereby incorporated by reference herein.

BACKGROUND

Technical Field

The present disclosure relates to a liquid discharge apparatus.

Description of the Related Art

A liquid discharge head generally includes a nozzle plate having nozzles thereon and a maintenance unit for maintaining the nozzles. The maintenance unit generally includes a cap for capping the surface of the nozzle plate and a wiper for wiping the surface of the nozzle plate. The wiper wipes the surface of the nozzle plate to remove a waste liquid remaining thereon.

SUMMARY

In accordance with some embodiments of the present invention, a liquid discharge apparatus is provided. The liquid discharge apparatus includes a liquid discharge head, a cap, and a wiper. The liquid discharge head includes a nozzle plate on which a nozzle is disposed, and the nozzle is configured to discharge a liquid. The cap is configured to cap a surface of the nozzle plate. The wiper is configured to move relative to the nozzle plate to wipe the surface of the nozzle plate. The surface of the nozzle plate has a cap contact region that is contactable with the cap. The wiper is configured to start wiping from a wiping start position that is disposed between both end parts of the cap contact region in a direction of wiping. The wiper is configured to come into contact with the surface of the nozzle plate at the wiping start position and move in a first direction to wipe the surface of the nozzle plate, and thereafter move in a second direction opposite the first direction to wipe the surface of the nozzle plate.

In accordance with some embodiments of the present invention, another liquid discharge apparatus is provided. The liquid discharge apparatus includes a liquid discharge head, a cap, a wiper, and a presser. The liquid discharge head includes a nozzle plate on which a nozzle is disposed, and the nozzle is configured to discharge a liquid. The cap is configured to cap a surface of the nozzle plate. The wiper is configured to move relative to the nozzle plate to wipe the surface of the nozzle plate. The presser is configured to press the wiper against the surface of the nozzle plate. The presser includes a first pressing part and a second pressing part each expressing different pressing forces.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
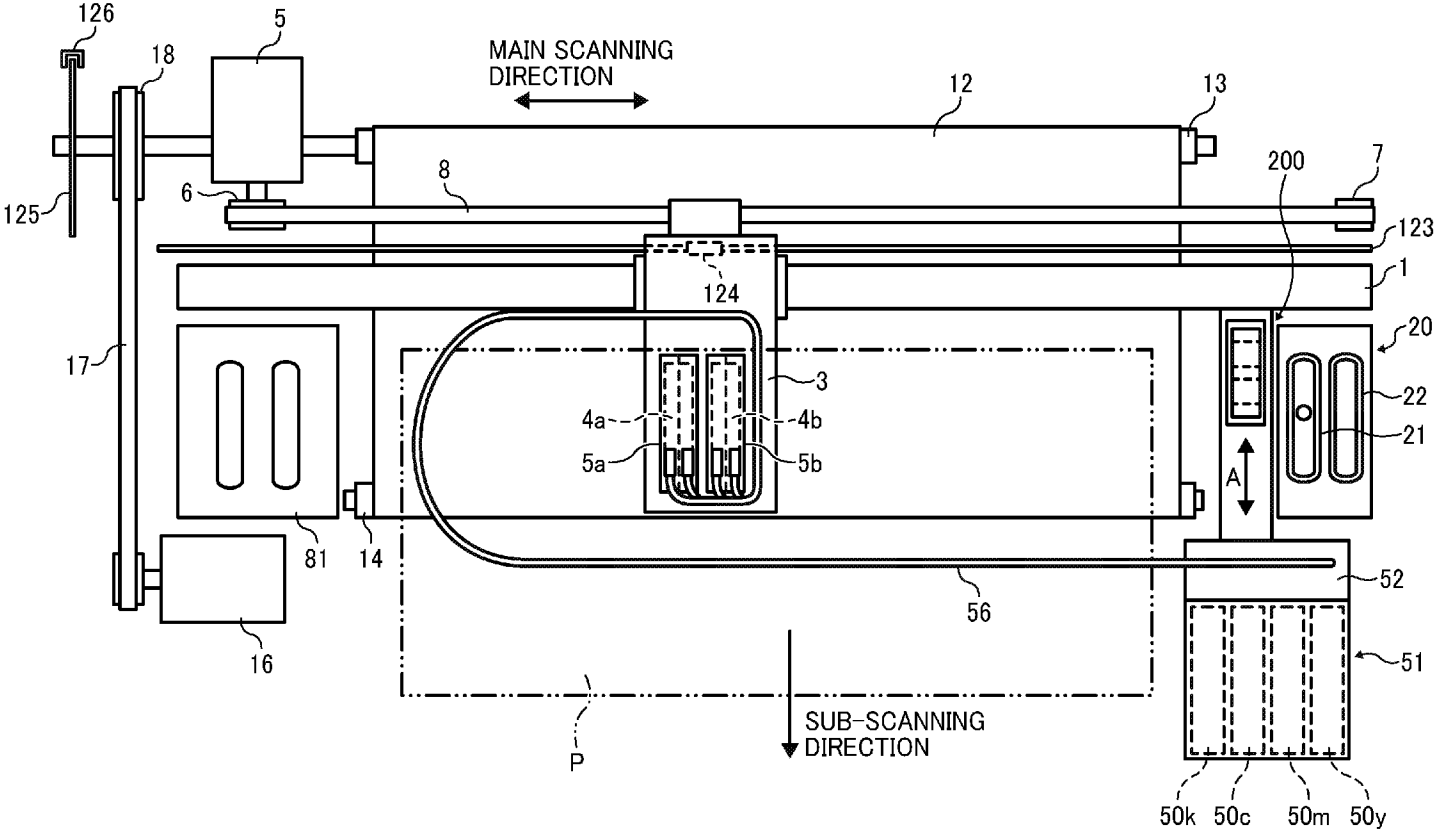
FIG. 1 is a plan view of a mechanical section of a liquid discharge apparatus according to some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a liquid discharge apparatus is provided the nozzle plate of which can be reliably cleaned.

Figure 2:
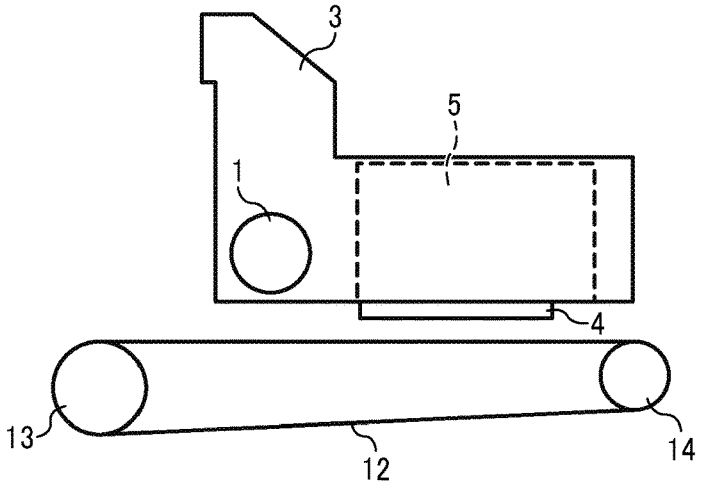
FIG. 2 is a side view of the mechanical section of the liquid discharge apparatus illustrated in FIG. 1.
Figure 3:
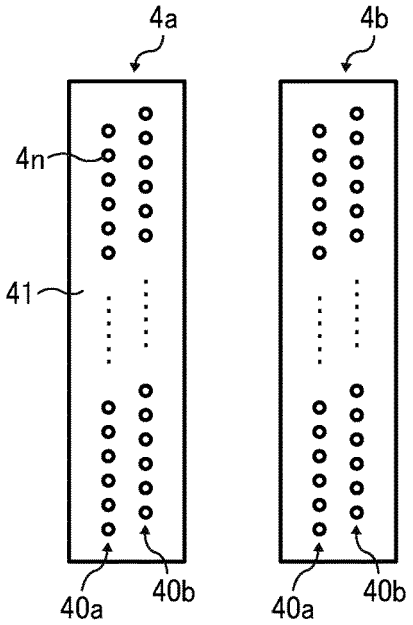
FIG. 3 is a plan view of heads of the liquid discharge apparatus illustrated in FIG. 1.

A liquid discharge apparatus according to some embodiments of the present invention is described in detail below with reference to FIGS. 1 to 3. FIGS. 1 and 2 are plan and side views, respectively, of a mechanical section of the liquid discharge apparatus. FIG. 3 is a plan view of a head of the liquid discharge apparatus. In FIG. 3, the head is illustrated in a transmissive manner from up above.

The liquid discharge apparatus illustrated in FIG. 1 is of a serial type. A main guide 1 is bridged across side plates disposed on right and left sides thereof. The main guide 1 movably supports a carriage 3 in a main scanning direction. A main scanning motor 5 reciprocates the carriage 3 in the main scanning direction (i.e., carriage moving direction) via a timing belt 8 that is stretched between a driving pulley 6 and a driven pulley 7.

The carriage 3 carries two liquid discharge heads 4*a* and 4*b* (hereinafter simply "heads 4*a* and 4*b*", "heads 4", or "head 4") and head tanks 5*a* and 5*b* that supply liquids to the respective heads 4*a* and 4*b*.

Referring to FIG. 3, the heads 4*a* and 4*b* each have two nozzle arrays 40*a* and 40*b*. The nozzle arrays 40*a* and 40*b* each have multiple nozzles 4*n*. The nozzle arrays 40*a* and 40*b* are displaced in the nozzle array direction so that the nozzles in both nozzle arrays are arranged in a staggered manner.

The nozzle arrays 40*a* and 40*b* of the head 4*a* discharge a black liquid and a cyan liquid, respectively. The nozzle arrays 40*a* and 40*b* of the head 4*b* discharge a magenta liquid and a yellow liquid, respectively.

According to another embodiment, the liquid discharge heads 4*a* and 4*b* may be replaced with a single liquid discharge head having multiple nozzle arrays each for discharging different color liquids.

Examples of the liquid discharge head include, but are not limited to, a piezoelectric actuator (e.g., piezoelectric element) and a thermal actuator (e.g., heat element) that utilizes a phase change occurring in a liquid by film boiling caused by an electrothermal conversion element.

The head tanks 5*a* and 5*b* each include two tanks corresponding to the two nozzle arrays 40*a* and 40*b* of the respective heads 4*a* and 4*b*. According to another embodiment, multiple separate head tanks may be disposed corresponding to the number of nozzle arrays or the number of types of liquid to discharge.

Referring back to FIG. 1, on the apparatus body, a cartridge holder 51 is disposed. On the cartridge holder 51, main tanks 50*y*, 50*m*, 50*c*, and 50*k* (hereinafter collectively "main tanks 50") containing respective color liquids are replaceably mounted.

The cartridge holder 51 includes a liquid feed pump unit 52 that supplies respective color liquids from the main tanks 50 to the head tanks 5*a* and 5*b* through respective supply tubes 56.

The liquid discharge apparatus further includes a conveyance belt 12 that conveys a sheet P, while adsorbing the sheet P, to a position where the sheet P faces the heads 4. The conveyance belt 12 is in the form of an endless belt. The conveyance belt 12 is stretched between a conveyance roller 13 and a tension roller 14.

A sub-scanning motor 16 rotary-drives the conveyance roller 13 via a timing belt 17 and a timing pulley 18, so that the peripheral surface of the conveyance belt 12 moves in the sub-scanning direction. While moving, the peripheral surface of the conveyance belt 12 is charged (given a charge) by a charging roller or sucks the sheet P with a suction device.

On one side of the carriage 3 in the main scanning direction, a maintenance unit 20 for maintaining the heads 4 is disposed lateral to the conveyance belt 12. On the other side, a dummy discharge receptacle 81 for receiving dummy discharge from the heads 4 is disposed lateral to the conveyance belt 12.

The maintenance unit 20 includes a sucking and moisturizing cap 21 and a moisturizing cap 22 each for capping the surfaces of nozzle plates 41 of the heads 4, and a wiping unit 200 for wiping the surfaces of the nozzle plates 41. The cap 21 is connected to a suction device.

An encoder scale 123 having a specific pattern thereon is stretched between both side plates in the main scanning direction of the carriage 3. The carriage 3 carries an encoder sensor 124 that reads the pattern on the encoder scale 123. The encoder sensor 124 includes a transmissive photosensor. The encoder scale 123 and the encoder sensor 124 configure a linear encoder (main scanning encoder) that detects movement of the carriage 3.

A code wheel 125 is mounted on the shaft of the conveyance roller 13. An encoder sensor 126 is mounted on the code wheel 125 that detects a pattern formed on the code wheel 125. The encoder sensor 126 includes a transmissive photosensor. The code wheel 125 and the encoder sensor 126 configure a rotary encoder (sub-scanning encoder) that detects the amount of movement and position of the conveyance belt 12.

The sheet P is fed onto the conveyance belt 12 and conveyed in the sub-scanning direction as the peripheral surface of the conveyance belt 12 moves, while being sucked by the conveyance belt 12.

While the carriage 3 is moved in the main scanning direction, the heads 4 are driven based on a recording signal and caused to discharge ink droplets onto the sheet P, thus recording one line image on the sheet P. The sheet P is thereafter conveyed in the sub-scanning direction for a specified distance so that a next line image is recorded thereon.

In response to a recording end signal or a signal indicating that the rear end of the sheet P has reached a recording area, the recording operation is ended and the sheet P is ejected onto a sheet ejection tray.

Figure 4:
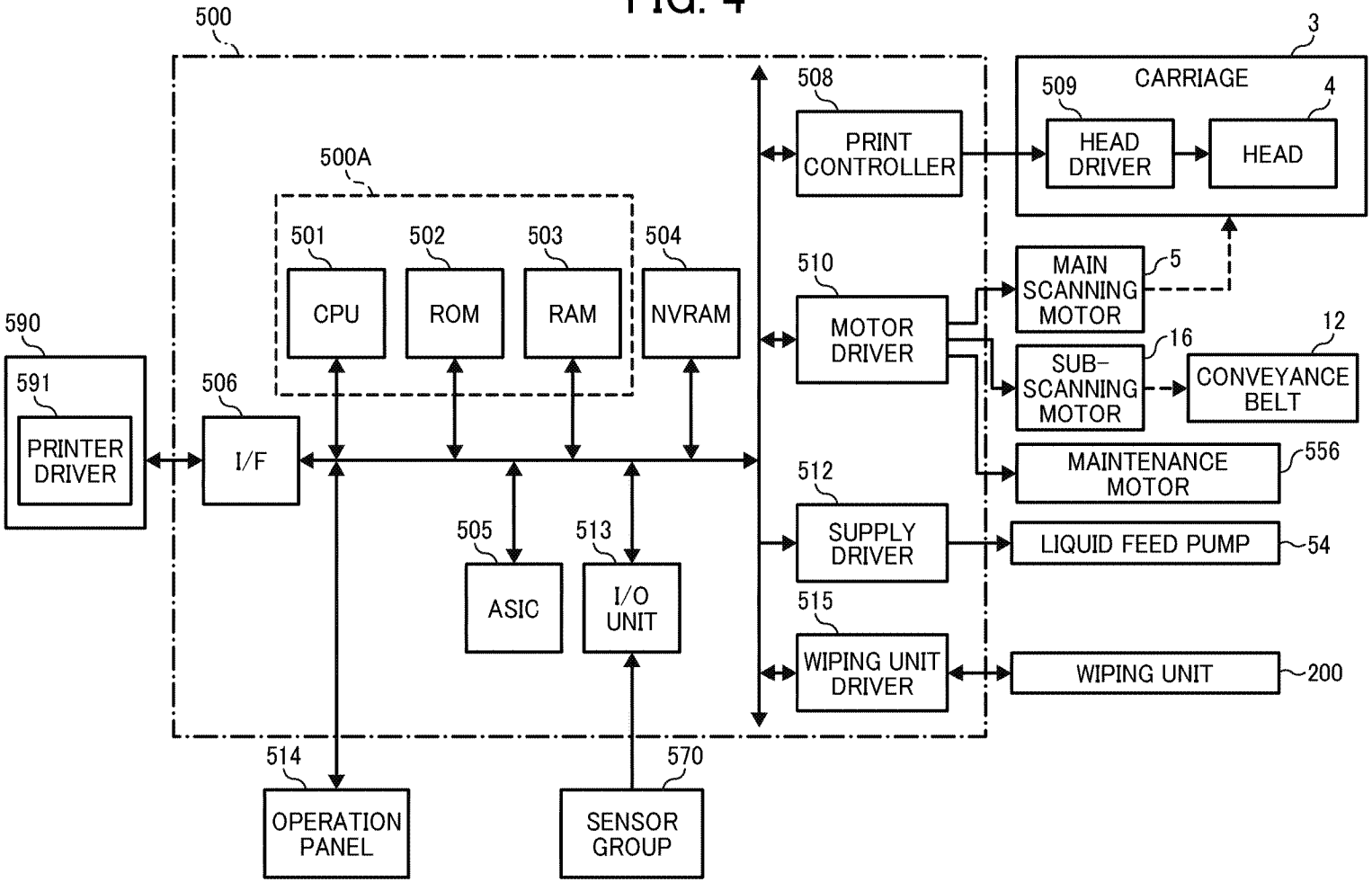
FIG. 4 is a block diagram of a controller of the liquid discharge apparatus illustrated in FIG. 1.

A controller of the above liquid discharge apparatus is described in detail below with reference to FIG. 4. FIG. 4 is a block diagram of the controller.

A controller 500 includes a main controller 500A including a central processing unit (CPU) 501, a read only memory (ROM) 502, and a random access memory (RAM) 503. The CPU 501 controls the overall apparatus. The ROM 502 stores fixed data including various programs to be executed by the CPU 501. The RAM 503 temporarily store data such as image data.

The controller 500 further includes a non-volatile random access memory (NVRAM) 504 and an application specific integrated circuit (ASIC) 505. The NVRAM 504 is rewritable even when the apparatus is powered off, for maintaining data. The ASIC 505 executes various signal processings for image data, image processings such as rearrangement, and input and output signal processings for controlling the overall apparatus.

The controller 500 further includes a print controller 508 for driving and controlling the heads 4, and a head driver (driver IC) 509 for driving the heads 4. The print controller 508 includes a data transmitter and a driving signal generator. The head driver 509 is mounted on the carriage 3.

The controller 500 further includes a motor driver 510 that drives the main scanning motor 5, the sub-scanning motor 16, and a maintenance motor 556. The main scanning motor 5 moves the carriage 3. The sub-scanning motor 16 moves the peripheral surface of the conveyance belt 12. The maintenance motor 556 moves the caps 21 and 22 up and down and drives the suction device of the maintenance unit 20.

The controller 500 further includes a supply driver 512 for driving a liquid feed pump 54 in the liquid feed pump unit 52 that feeds liquids from the main tanks 50 to the heads 4.

The controller 500 further includes a wiping unit driver 515 for driving each part of the wiping unit 200.

The controller 500 further includes an input/output (I/O) unit 513. The I/O unit 513 acquires information from a sensor group 570 that includes various sensors mounted on the apparatus, such as a temperature sensor. The I/O unit 513 then extracts information needed for controlling the apparatus and uses the extracted information when controlling the apparatus.

The controller 500 is connected to an operation panel 514 through which necessary information is input or displayed.

The controller 500 further includes an interface (I/F) 506 for transmitting and receiving data or signals to/from a host 590, such as an information processor (e.g., personal computer), an image reader, and an imaging device. The I/F 506 receives information from a printer driver 591 of the host 590 via a cable or network.

In the controller 500, the CPU 501 reads out print data from a receive buffer in the I/F 506 and analyzes the print data. The ASIC 505 executes necessary image processings or rearrangement of data to obtain image data. The image data is transferred from the print controller 508 to the head driver 509.

The print controller 508 transfers the image data to the head driver 509 as serial data, while outputting a transfer clock, latch signal, and control signal thereto, that are needed for transferring the image data and confirming the transfer.

The print controller 508 includes a driving signal generator that includes a D/A converter, a voltage amplifier, and a current amplifier. The D/A converter executes a digital-to-analog conversion of pattern data of driving pulse stored in the ROM 502. The print controller 508 generates a drive waveform consisting of single drive pulse or multiple drive pulses, and outputs the drive waveform to the head driver 509.

The head driver 509 selects one or more drive pulses from the drive waveform received from the print controller 508, based on serially-input image data corresponding to one line of the heads 4, and gives the selected drive pulses to the pressure generators of the heads 4, thus driving the heads 4. The size of dots is determined by the size of liquid droplets. The size of liquid droplets is determined depending on whether all or part of the drive pulses composing the drive waveform are/is selected, or all or part of wave components composing the drive pulse are/is selected.

Figure 5:
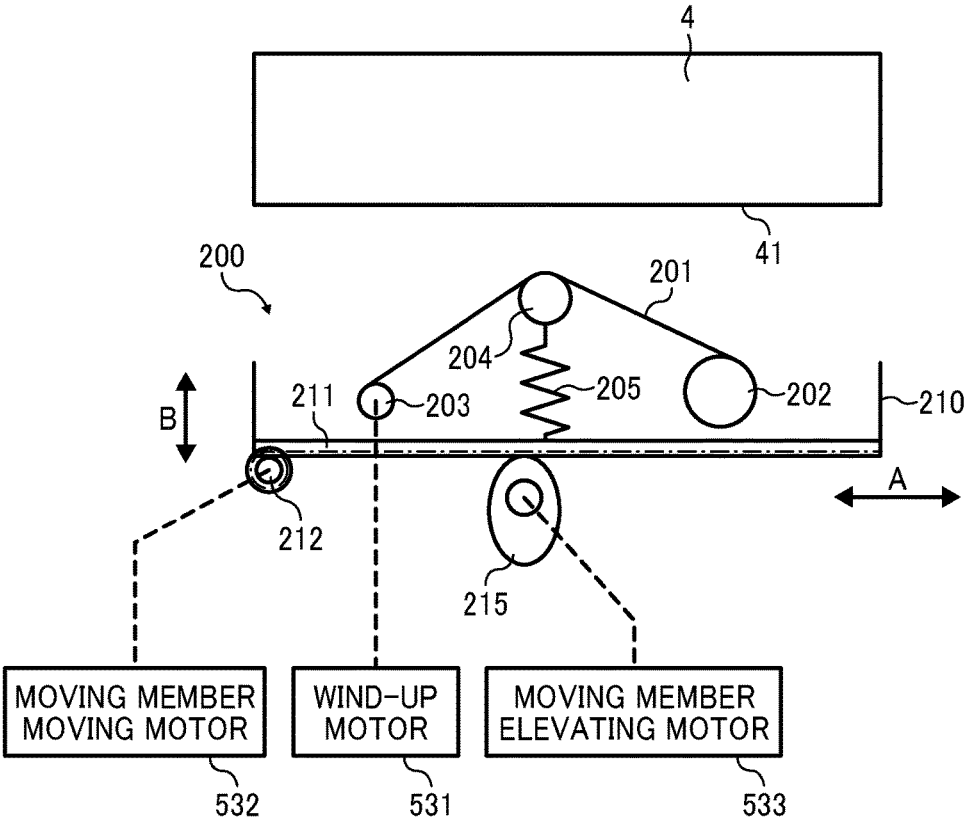
FIG. 5 is a schematic view of a wiping unit according to a first embodiment of the present invention.

A first embodiment of the present invention is described in detail below with reference to FIG. 5. FIG. 5 is a schematic view of the wiping unit 200 according to the first embodiment.

The wiping unit 200 includes a web 201, serving as a belt-shaped wiper, that wipes the surface of the nozzle plate 41 of the head 4. (The web 201 may be hereinafter referred to as "wiper".) Preferably, the web 201 is made of a sheet-like material having absorption property and liquid resistance, that is prevented from causing scuffing and generating dust. Specific examples of such materials include, but are not limited to, non-woven fabric, cloth, film, and paper.

The web 201 has been wound around a pick-up roller (supply roller) 202. The web 201 is drawn from the pick-up roller 202 and wound up by a wind-up roller 203. Between the pick-up roller 202 and the wind-up roller 203, a pressing roller 204, serving as a presser, is disposed. The pressing roller 204 presses the web 201 against the surface of the nozzle plate 41 when wiping the surface of the nozzle plate 41 with the web 201. The pressing roller 204 is biased in a direction of pressing by a spring 205.

The web 201, the pick-up roller 202, the wind-up roller 203, the pressing roller 204, and drive mechanisms such as a wind-up motor 531 for rotary-driving the wind-up roller 203, are mounted on a moving member 210. The moving member 210 is movable relative to the head 4.

The moving member 210 is movable in a direction indicated by arrow A, that is coincident with either the direction of wiping or the direction extending along the nozzle array 40 of the head 4 (i.e., nozzle array direction). The moving member 210 is moved in the direction of wiping by a moving mechanism including a rack 211, a pinion 212, and a moving member moving motor 532 that rotates the pinion 212.

According to another embodiment, the web 201 may be replaced with another web having a width corresponding to the width of the nozzle plate 41 in the nozzle array direction. In this case, the moving member 210 is moved in a direction perpendicular to the nozzle array direction when wiping the surface of the nozzle plate 41.

The moving member 210 is also movable in a direction indicated by arrow B, that is coincident with the direction of up-and-down movement (i.e., elevation) of the web 201 relative to the surface of the nozzle plate 41. The moving member 210 is moved up and down by an elevation mechanism including a cam 215 and a moving member elevating motor 533 that rotates the cam 215.

The wind-up motor 531 for rotary-driving the wind-up roller 203, the moving member moving motor 532 for moving the moving member 210 in the direction indicated by arrow A, and the moving member elevating motor 533 for moving the moving member 210 in the direction indicated by arrow B, are driven and controlled by the controller 500 via the wiping unit driver 515.

A transfer phenomenon of a waste liquid from a nip portion of the cap 21 onto the surface of the nozzle plate 41 is described below with reference to FIGS. 6A-6E and 7. In the embodiment described below, the cap 21 is configured to move.

Figure 6A:
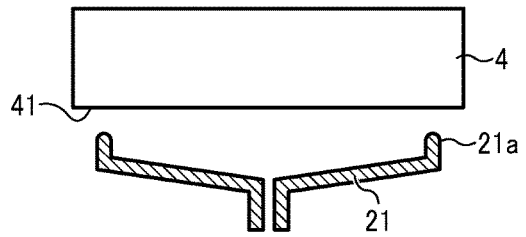
FIGS. 6A to 6E are illustrations for explaining a transfer phenomenon of a waste liquid from a nip portion of a suction cap onto the surface of a nozzle plate.
Figure 6B:
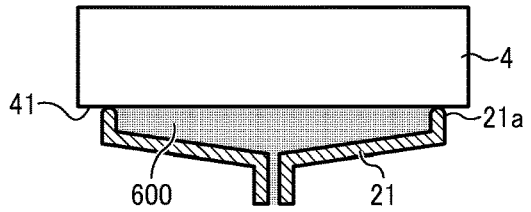

When maintaining the nozzle 4*n* on the nozzle plate 41, the cap 21 apart from the surface of the nozzle plate 41, as illustrated in FIG. 6A, is moved so as to cap the surface of the nozzle plate 41 as illustrated in FIG. 6B. To discharge a liquid from the nozzle 4*n*, the pressure within the cap 21 may be reduced so that the liquid is sucked from the nozzle 4*n*. Alternatively, another liquid may be supplied to the head 4 with pressure so that the liquid is discharged from the nozzle 4*n*.

Figure 6C:
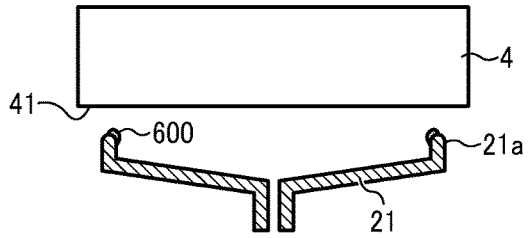

After the cap 21 is separated from the surface of the nozzle plate 41 and the wiper wipes the surface of the nozzle plate 41, a waste liquid 600 (i.e., the liquid discharged from the nozzle 4*n*) within the cap 21 is sucked and discharged. At this time, a part of the waste liquid 600 may remain on a nip portion 21*a* of the cap 21 as illustrated in FIG. 6C.

Figure 6D:
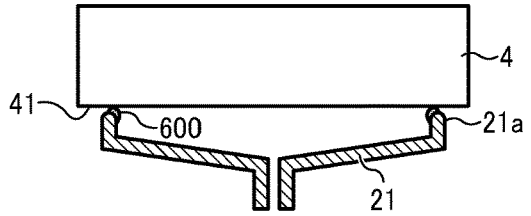
Figure 6E:
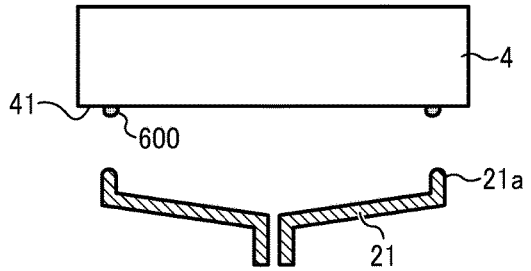
Figure 7:
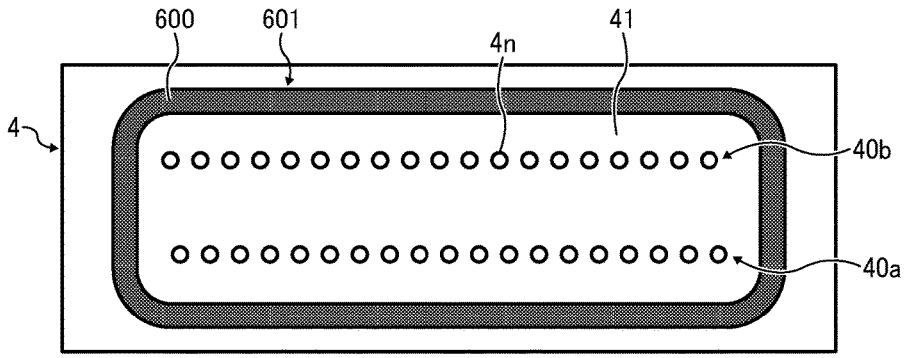
FIG. 7 is a plan view of a nozzle plate according to the first embodiment of the present invention.

When the surface of the nozzle plate 41 is capped with the cap 21 with the waste liquid 600 remaining on the nip portion 21*a* as illustrated in FIG. 6D, the waste liquid 600 is transferred onto the surface of the nozzle plate 41 as illustrated in FIG. 6E. The transferred waste liquid 600 remains on the surface of the nozzle plate 41 even when the cap 21 is separated from the surface of the nozzle plate 41.

In particular, the waste liquid 600 is transferred from the cap 21 onto a specific region on the surface of the nozzle plate 41. The specific region is defined as a cap contact region 601 illustrated in FIG. 7, where the nip portion 21*a* of the cap 21 is allowed to contact.

The waste liquid 600 transferred onto the surface of the nozzle plate 41 has been thickened due to evaporation of moisture that has been caused while the cap is separated from the surface of the nozzle plate 41. Thus, there may be a case in which the thickened waste liquid 600 is spread with the wiper and pushed into the nozzle 4*n* while the wiper wipes the surface of the nozzle plate 41 from one end thereof.

Figure 8:
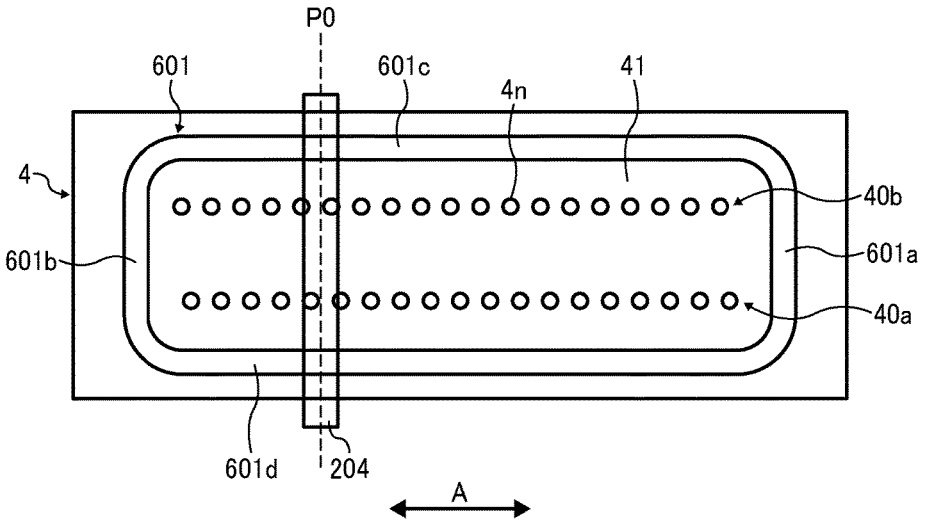
FIG. 8 is a plan view of the nozzle plate, viewed from a wiper side, for explaining a wiping start position according to the first embodiment of the present invention.

A wiping start position according to the first embodiment is described below with reference to FIG. 8. FIG. 8 is a plan view of the nozzle plate 41 viewed from the wiper side, for explaining a wiping start position according to the first embodiment. In FIG. 8, the position where the wiper contacts the surface of the nozzle plate 41 is indicated by the position of the pressing roller 204.

In the present embodiment, the nip portion 21*a* of the cap 21 has a planer and substantially rectangular shape. Thus, the waste liquid is transferred onto the cap contact region 601 having a substantially rectangular shape on the surface of the nozzle plate 41.

In a case in which the direction of wiping is coincident with a longitudinal direction of the surface of the nozzle plate 41 (i.e., the nozzle array direction indicated by arrow A), the cap contact region 601 includes end parts 601*a* and 601*b* disposed outside the nozzle 4*n* (and the nozzle array 40) in the direction of wiping.

In the present embodiment, the end parts 601*a* and 601*b* are coincident with short sides of the cap contact region 601 having a substantially rectangular shape, onto which the waste liquid is transferred as the nip portion 21*a* of the cap 21 continuously contacts over a large area of the surface of the nozzle plate 41 in a direction perpendicular to the direction of wiping.

If the wiping is started from an outside of one of the end parts 601*a* and 601*b* in the direction of wiping, the thickened waste liquid transferred onto the end parts 601*a* and 601*b* may be spread into a region where the nozzle 4*n* is disposed and pushed into the nozzle 4*n*.

To prevent such a phenomenon, in the present embodiment, a wiping start position P0 is disposed between the end parts 601*a* and 601*b* of the cap contact region 601 in the direction of wiping indicated by arrow A.

At the wiping start position P0, the wiper contacts end parts 601*c* and 601*d* of the cap contact region 601. The end parts 601*c* and 601*d* are coincident with long sides of the cap contact region 601 having a substantially rectangular shape. The end parts 601*c* and 601*d* are disposed separated from each other outside the nozzle 4*n* in the direction perpendicular to the direction of wiping.

Figure 9A:
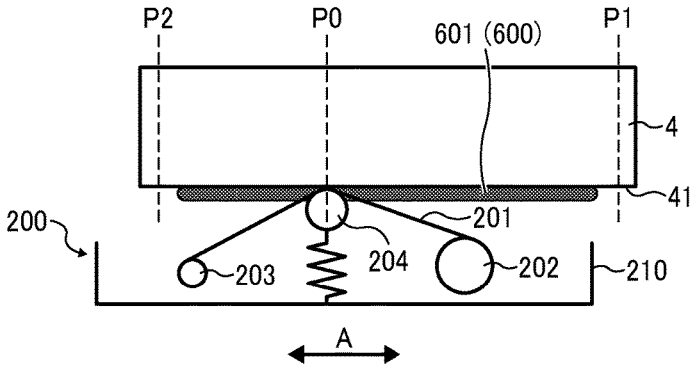
FIGS. 9A to 9C are illustrations for explaining a wiping operation according to the first embodiment of the present invention.
Figure 9B:
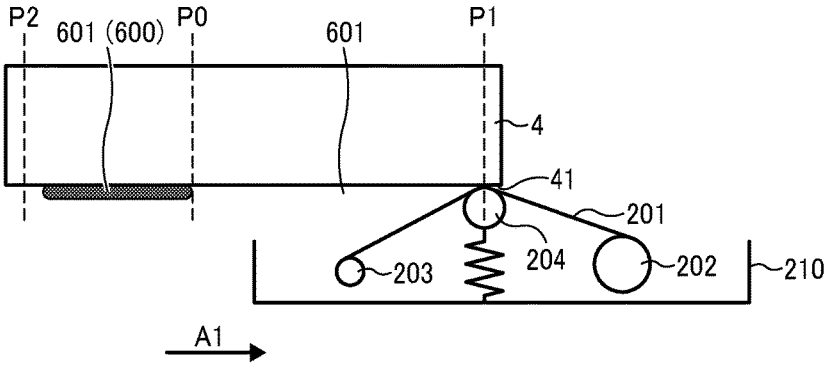
Figure 9C:
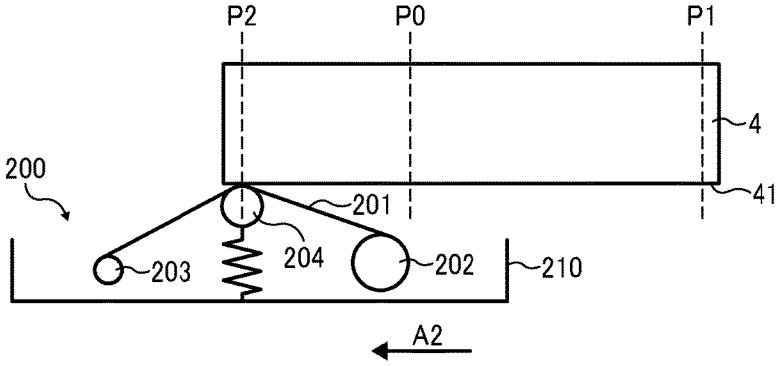
Figure 10A:
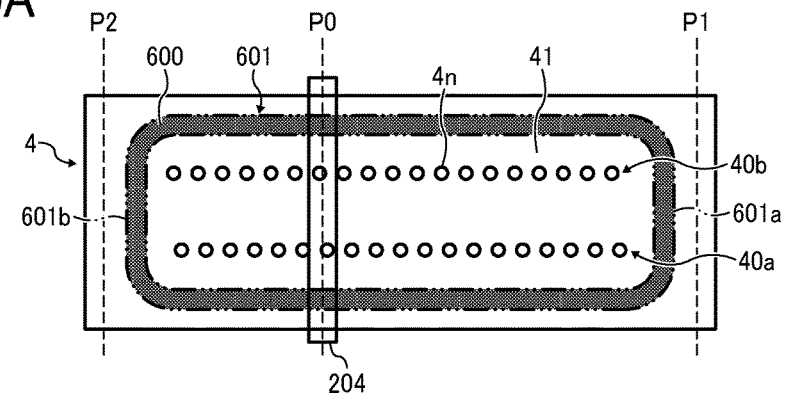
FIGS. 10A to 10C are plan views of the nozzle plate, viewed from a wiper side during the wiping operation according to the first embodiment of the present invention.
Figure 10B:
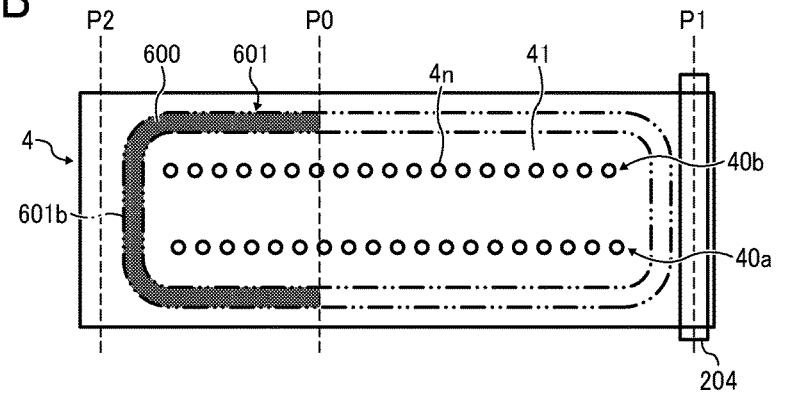
Figure 10C:
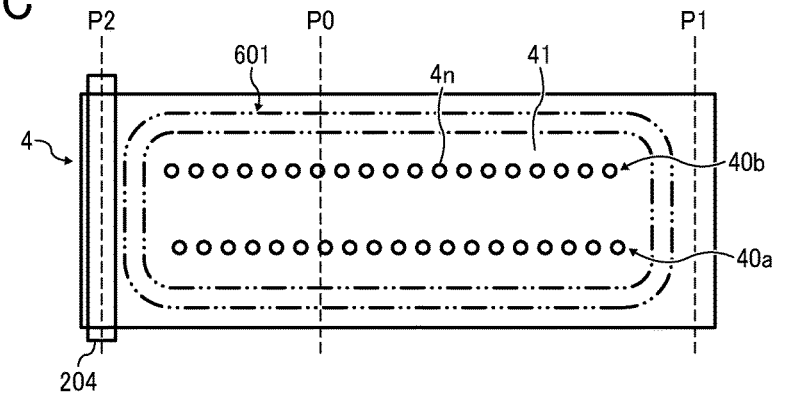

A wiping operation according to the first embodiment is described below with reference to FIGS. 9A-9C and 10A-10C. FIGS. 9A-9C are illustrations for explaining a wiping operation according to the first embodiment. FIGS. 10A-10C are plan views of the nozzle plate 41 viewed from the wiper side during the wiping operation according to the first embodiment.

When the wiping operation is started, the web 201 (wiper) is brought into contact with the surface of the nozzle plate 41 at the wiping start position P0, as illustrated in FIGS. 9A and 10A.

The moving member 210 is then moved in a first direction of wiping indicated by arrow A1 from the wiping start position P0 to a first position P1 disposed outside the end part 601*a* in the direction of wiping, and the moving member 210 is stopped moving at P1, as illustrated in FIGS. 9B and 10B.

At this time, the waste liquid 600 having been transferred onto the end part 601*a* of the cap contact region 601 is wiped outside the nozzle 4*n* in the direction of wiping. Therefore, the thickened waste liquid 600 transferred onto the end part 601*a* is prevented from being pushed into the nozzle 4*n*. Since the first position P1 where the wiper ends wiping in the first direction is disposed outside the cap contact region 601 in the direction of wiping, the waste liquid on the end part 601*a* can be completely wiped off.

Next, the moving member 210 is moved in a second direction of wiping indicated by arrow A2, opposite to the first direction, from the first position P1 to a second position P2 disposed outside the end part 601*b* in the direction of wiping, and the moving member 210 is stopped moving at P2, as illustrated in FIGS. 9C and 10C.

At this time, the waste liquid 600 having been transferred onto the end part 601*b* of the cap contact region 601 is wiped outside the nozzle 4*n* in the direction of wiping. Therefore, the thickened waste liquid 600 transferred onto the end part 601*b* is prevented from being pushed into the nozzle 4*n*. Since the second position P2 where the wiper ends wiping in the second direction is disposed outside the cap contact region 601 in the direction of wiping, the waste liquid on the end part 601*b* can be completely wiped off.

According to the present embodiment, the wiping start position P0 is disposed between two positions each disposed outside either the nozzle 4*n* and the cap contact region 601, in the direction of wiping. In addition, the wiping operation is started at a position disposed between both end parts 601*a* and 601*b* of the cap contact region 601 and ended at a position outside the cap contact region 601, in the direction of wiping.

Thus, the thickened waste liquid transferred onto an outside of the nozzle 4*n* in the direction of wiping is never wiped toward the nozzle 4*n* side, never spread on the surface of the nozzle plate 41, and never pushed into the nozzle 4*n*. The surface of the nozzle plate 41 can be reliably cleaned.

In a case in which the direction of wiping is coincident with a short direction of the surface of the nozzle plate 41, the wiping start position P0 is set between the end parts 601*c* and 601*d* of the cap contact region 601.

Figure 11:
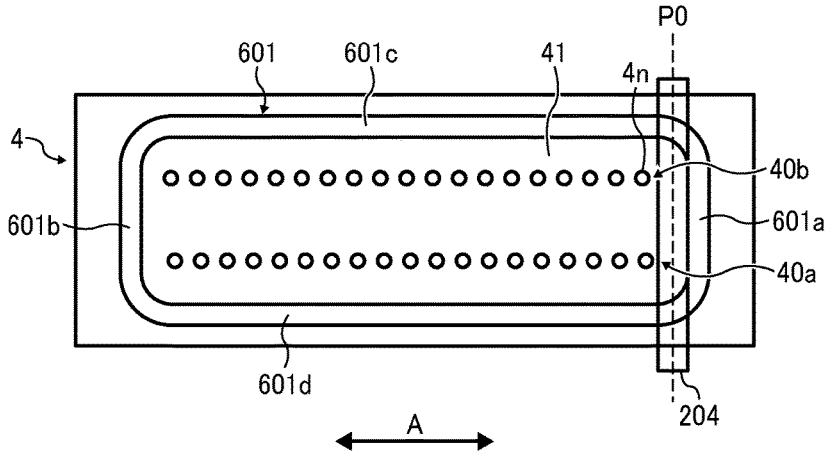
FIG. 11 is a plan view of a nozzle plate, viewed from a wiper side, for explaining a wiping start position according to a second embodiment of the present invention.

A second embodiment of the present invention is described in detail below with reference to FIG. 11. FIG. 11 is a plan view of the nozzle plate 41 viewed from the wiper side, for explaining a wiping start position according to the second embodiment.

In the second embodiment, the wiping start position P0 is disposed between one end part 601*a* (or end part 601*b*) of the cap contact region 601 and a terminal nozzle 4*n* in the nozzle array 40, in the direction of wiping.

The wiper (web 201) is brought into contact with the surface of the nozzle plate 41 at the wiping start position P0 without contacting any nozzle. Thus, the wiper is less likely to destroy a meniscus of the nozzle 4*n*.

Figure 12:
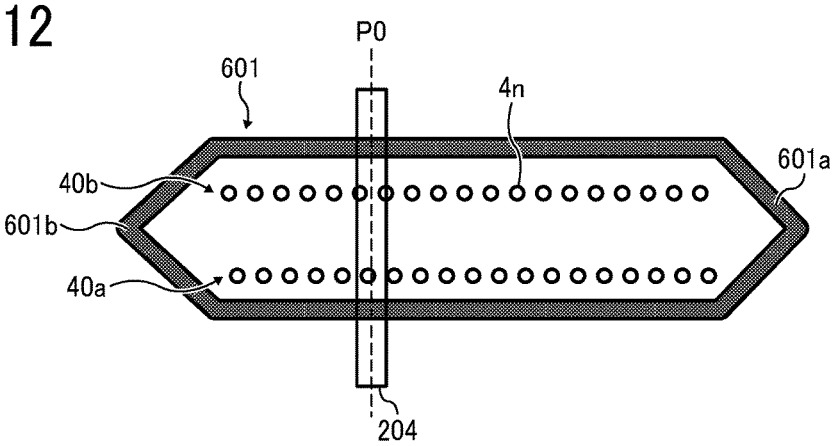
FIGS. 12 and 13 are illustrations of cap contact regions, varied depending on the shape of a nip portion of a cap, according to some embodiments of the present invention.
Figure 13:
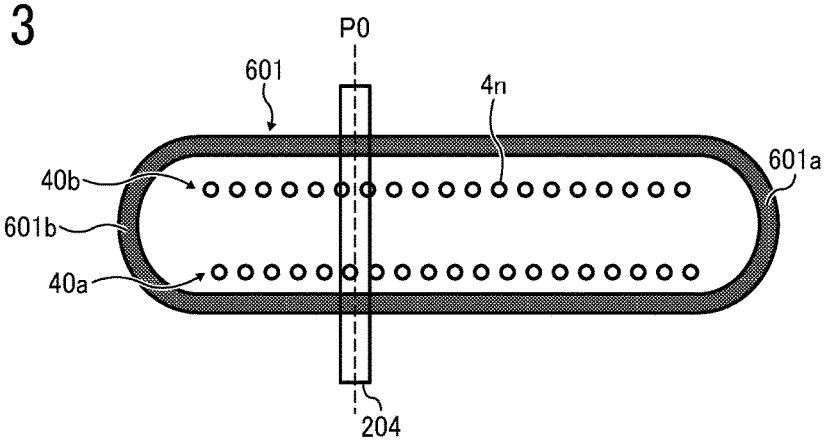

Other embodiments are described below with reference to FIGS. 12 and 13, in which the shape of the cap is varied. FIGS. 12 and 13 are illustrations of cap contact regions, varied depending on the shape of the nip portion of the cap, according to some embodiments of the present invention.

In the embodiment illustrated in FIG. 12 (hereinafter Example 1), the end parts 601*a* and 601*b* of the cap contact region 601 each have a substantially triangular shape.

In the embodiment illustrated in FIG. 13 (hereinafter Example 2), the end parts 601*a* and 601*b* of the cap contact region 601 each have a substantially semicircular shape.

Compared to the first and second embodiments described above in which the cap contact region 601 has a substantially rectangular shape, the area where the waste liquid is to be transferred is much smaller in Examples 1 and 2. However, there is no difference in the fact that the thickened waste liquid is transferred onto an outside of the nozzle 4*n* in the direction of wiping.

Accordingly, the same effect is provided even when the cap contact region 601 has a shape illustrated in FIG. 12 or 13.

In place of a belt-shaped wiper (web) used in the above-described embodiments, a blade-like member may also be used. Even in this case, the same effect is provided.

Figure 14:
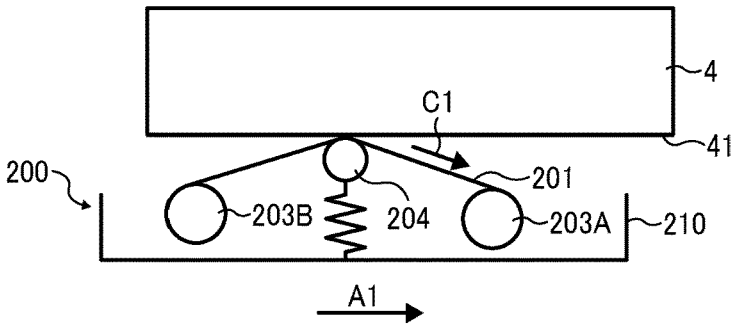
FIG. 14 is a schematic view of a wiping unit according to a third embodiment of the present invention.

A third embodiment of the present invention is described in detail below with reference to FIG. 14. FIG. 14 is a schematic view of the wiping unit 200 according to the third embodiment.

In the wiping unit 200 according to the third embodiment, both ends of the web 201 are connected to respective wind-up rollers 203A and 203B. As the wind-up roller 203A or 203B is rotary-driven, the web 201 is moved relative to the moving member 210 and wound up thereby.

In the present embodiment, when the moving member 210 is moved in a first direction of wiping indicated by arrow A1, the wind-up roller 203A is rotary-driven to move the web 201 relative to the surface of the nozzle plate 41 in a direction indicated by arrow C1.

In the present embodiment, the web 201 is moved in the same direction as a direction of movement of the moving member 210 (i.e., the direction of wiping).

Thus, the moving speed of the web 201 relative to the surface of the nozzle plate 41 is increased without increasing the moving speed of the moving member 210, thereby removing the waste liquid adhered to the surface of the nozzle plate 41 with higher efficiency.

Figure 15:
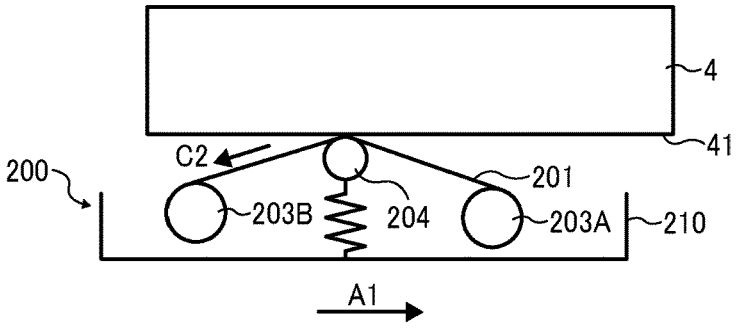
FIG. 15 is a schematic view of a wiping unit according to a fourth embodiment of the present invention.

A fourth embodiment of the present invention is described in detail below with reference to FIG. 15. FIG. 15 is a schematic view of the wiping unit 200 according to the fourth embodiment.

In the wiping unit 200 according to the fourth embodiment, both ends of the web 201 are connected to respective wind-up rollers 203A and 203B. As the wind-up roller 203A or 203B is rotary-driven, the web 201 is moved relative to the moving member 210 and wound up thereby.

In the present embodiment, when the moving member 210 is moved in a first direction of wiping indicated by arrow A1, the wind-up roller 203B is rotary-driven to move the web 201 relative to the surface of the nozzle plate 41 in a direction indicated by arrow C2.

In the present embodiment, the web 201 is moved in an opposite direction to a direction of movement of the moving member 210 (i.e., the direction of wiping).

Thus, the moving speed of the web 201 relative to the surface of the nozzle plate 41 is decreased, thereby reducing contact load on the surface of the nozzle plate 41 and damage to a liquid repelling film on the surface of the nozzle plate 41.

It is possible to combine the third and fourth embodiments and properly use one of them depending on the degree of drying or adherence of the waste liquid. For example, it is possible to use the fourth embodiment when the time elapsed from the previous wiping operation is within a specific time and to use the third embodiment when the time elapsed from the previous wiping operation is beyond the specific time.

Figure 16:
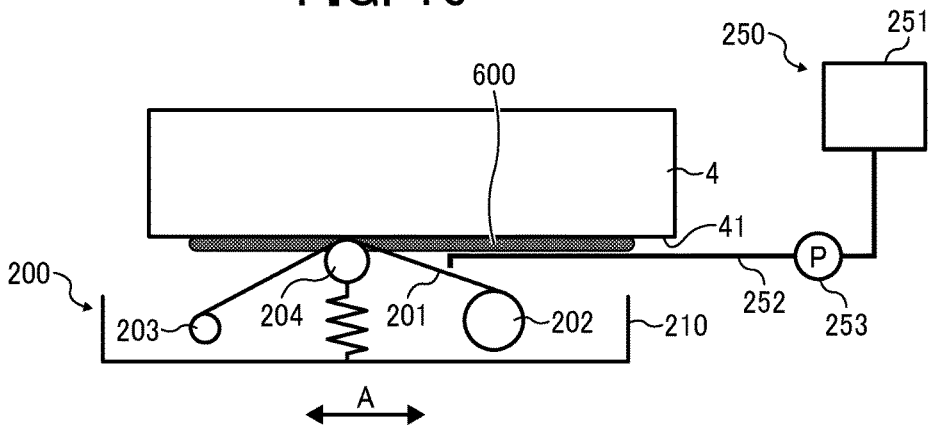
FIG. 16 is a schematic view of a wiping unit according to a fifth embodiment of the present invention.

A fifth embodiment of the present invention is described in detail below with reference to FIG. 16. FIG. 16 is a schematic view of the wiping unit 200 according to the fifth embodiment.

In the present embodiment, the wiping unit 200 further includes a cleaning liquid applicator 250. The cleaning liquid applicator 250 includes a cleaning liquid tank 251, a cleaning liquid supply path 252, and a pump 253. The cleaning liquid tank 251 contains a cleaning liquid to be applied to the web 201. The cleaning liquid supply path 252 supplies the cleaning liquid from the cleaning liquid tank 251 to the web 201. The pump 253 feeds the cleaning liquid.

The cleaning liquid is allowed to permeate the web 201 before a wiping operation is started. Thus, the web 201 is improved in the ability of absorbing the waste liquid and that of removing the waste liquid adhered to the surface of the nozzle plate 41.

Figure 17A:
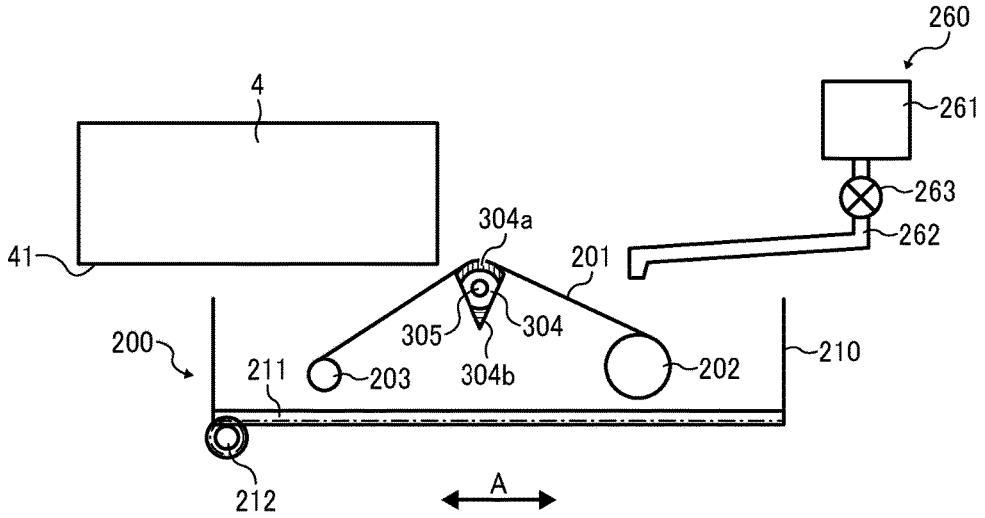
FIGS. 17A and 17B are schematic views of a wiping unit according to a sixth embodiment of the present invention.
Figure 17B:
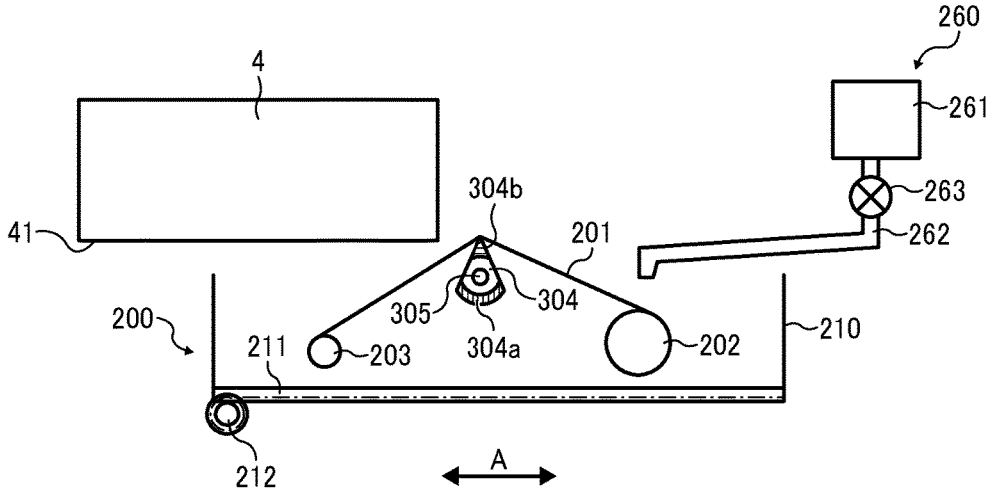
Figure 18:
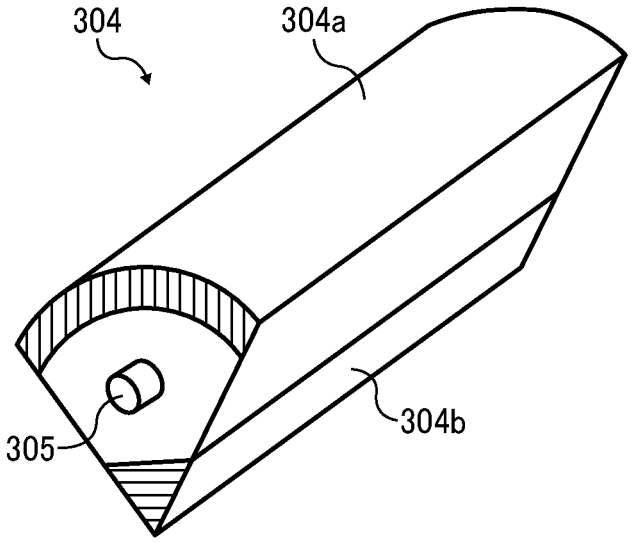
FIG. 18 is a perspective view of a presser according to the sixth embodiment of the present invention.

A sixth embodiment of the present invention is described in detail below with reference to FIGS. 17A-17B and 18. FIGS. 17A and 17B are schematic views of the wiping unit 200 according to the sixth embodiment in different states. FIG. 18 is a perspective view of a presser according to the sixth embodiment.

The wiping unit 200 includes the web 201, serving as a belt-shaped wiper, that wipes the surface of the nozzle plate 41 of the head 4.

The web 201 has been wound around the pick-up roller 202. The web 201 is drawn from the pick-up roller 202 and wound up by the wind-up roller 203. Between the pick-up roller 202 and the wind-up roller 203, a presser 304 is disposed. The presser 304 presses the web 201 against the surface of the nozzle plate 41 when wiping the surface of the nozzle plate 41 with the web 201.

The web 201, the pick-up roller 202, the wind-up roller 203, the presser 304, and drive mechanisms such as a wind-up motor for rotary-driving the wind-up roller 203 and a motor for rotating the presser 304, are mounted on the moving member 210. The moving member 210 is movable relative to the head 4.

The moving member 210 is movable in a direction indicated by arrow A, that is coincident with either the direction of wiping or the direction extending along the nozzle array 40 of the head 4 (i.e., nozzle array direction). The moving member 210 is moved in the direction of wiping by a moving mechanism including the rack 211, the pinion 212, and a moving member moving motor that rotates the pinion 212.

According to another embodiment, the web 201 may be replaced with another web having a width corresponding to the width of the nozzle plate 41 in the nozzle array direction. In this case, the moving member 210 is moved in a direction perpendicular to the nozzle array direction when wiping the surface of the nozzle plate 41.

The presser 304 includes a first pressing part 304*a* and a second pressing part 304*b* each expressing different pressing forces. The presser 304 is rotatably supported by a shaft 305 relative to the moving member 210.

The first pressing part 304*a* is in a circular arc shape and formed of a material having a relatively low hardness (e.g., a Vickers hardness of 30 degrees or less), such as rubbers. The second pressing part 304*b* is in an edge shape and formed of a material having a relatively high hardness (e.g., a Vickers hardness of 90 degrees or more), such as rubbers and resin materials (e.g., elastomers, POM (polyoxymethylene), PE (polyethylene)).

The pressing force of the first pressing part 304*a* for pressing the web 201 against the surface of the nozzle plate 41 is weaker than that of the second pressing part 304*b* for pressing the web 201 against the surface of the nozzle plate 41.

In the present embodiment, the wiping unit 200 further includes a liquid applicator 260. The liquid applicator 260 includes a liquid tank 261, a liquid supply path 262, and an on-off valve 263. The liquid tank 261 contains a liquid to be applied to the web 201. The liquid supply path 262 supplies the liquid from the liquid tank 261 to the web 201. The on-off valve 263 opens and closes the liquid supply path 262.

The liquid applied to the web 201 is spread by a capillary action, thus forming a wet region on the web 201.

Examples of the liquid include a moisturizing liquid. When a low-volatile solvent is used as the moisturizing liquid, the waste liquid absorbed by the web 201 is prevented from drying or becoming powdery. When the moisturizing liquid is equivalent to the main solvent in the liquid discharged from the head 4, the moisturizing liquid is evaporated from the web 201 and the solvent vapor pressure near the surface of the nozzle plate 41 is increased. Therefore, liquids present near the nozzle 4*n* are prevented from drying.

Examples of the liquid further include a cleaning liquid, as described in the above embodiment. In the following description, a cleaning liquid is employed as the liquid to be applied to the web 201.

A wiping operation in the present embodiment is described below with reference to FIGS. 19 and 20. FIGS. 19A to 19C are illustrations for explaining a first wiping operation. FIGS. 20A to 20C are illustrations for explaining a second wiping operation.

In the first wiping operation, the presser 304 is set such that the first pressing part 304*a* presses the web 201 against the surface of the nozzle plate 41, as illustrated in FIG. 17A.

The on-off valve 263 of the liquid applicator 260 is opened for a specified time (e.g., 5 seconds) to allow the cleaning liquid to permeate the web 201. The web 201 is wound up by the wind-up roller 203 such that a part of the web 201 impregnated with the cleaning liquid comes to a position where the presser 304 presses. At this time, a part of the web 201 contaminated in the previous wiping operation is wound up by the wind-up roller 203.

The carriage 3 is moved thereafter to move the head 4 to be wiped to above the wiping unit 200.

Figure 19A:
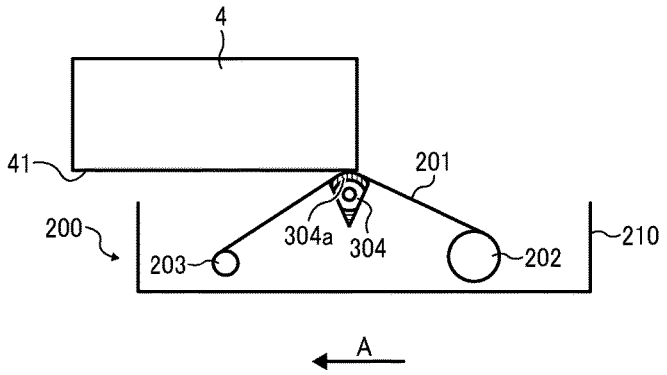
FIGS. 19A to 19C are illustrations for explaining a first wiping operation according to the sixth embodiment of the present invention.
Figure 19B:
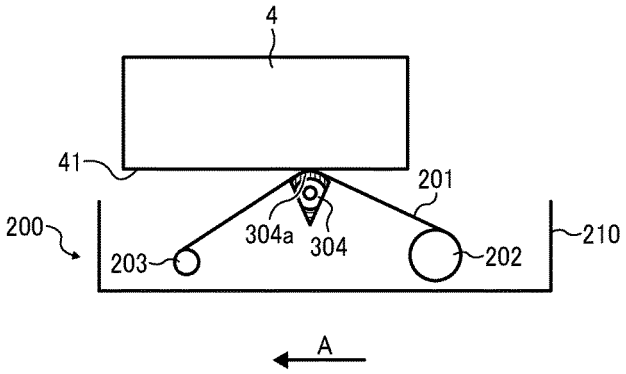

Next, the moving member 210 is moved in a direction of wiping indicated by arrow A from a wiping start position illustrated in FIG. 19A. The web 201 is then moved in the direction of wiping while being pressed against the surface of the nozzle plate 41, as illustrated in FIG. 19B, to wipe the surface of the nozzle plate 41.

Figure 19C:
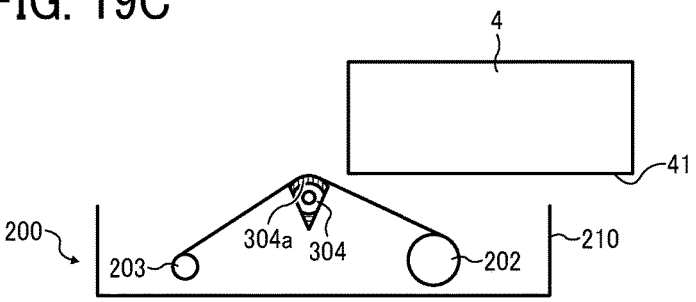

The moving member 210 is then stopped moving at a wiping end position illustrated in FIG. 19C.

In the second wiping operation, the presser 304 is set such that the second pressing part 304*b* presses the web 201 against the surface of the nozzle plate 41, as illustrated in FIG. 17B.

The on-off valve 263 of the liquid applicator 260 is opened for a specified time (e.g., 5 seconds) to allow the cleaning liquid to permeate the web 201. The web 201 is wound up by the wind-up roller 203 such that a part of the web 201 impregnated with the cleaning liquid comes to a position where the presser 304 presses. At this time, a part of the web 201 contaminated in the previous wiping operation is wound up by the wind-up roller 203.

The carriage 3 is moved thereafter to move the head 4 to be wiped to above the wiping unit 200.

Figure 20A:
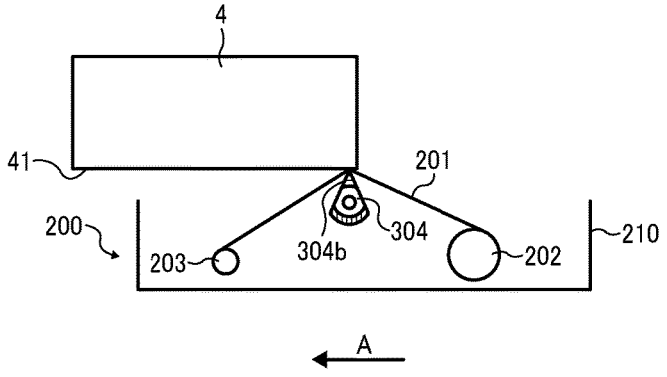
FIGS. 20A to 20C are illustrations for explaining a second wiping operation according to the sixth embodiment of the present invention.
Figure 20B:
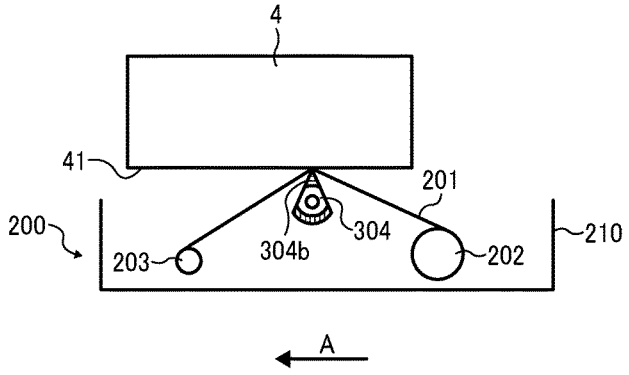

Next, the moving member 210 is moved in a direction of wiping indicated by arrow A from a wiping start position illustrated in FIG. 20A. The web 201 is then moved in the direction of wiping while being pressed against the surface of the nozzle plate 41, as illustrated in FIG. 20B, to wipe the surface of the nozzle plate 41.

The moving speed (wiping speed) of the moving member 210 in the second wiping operation is set lower than that in the first wiping operation, for more reliable wiping.

Figure 20C:
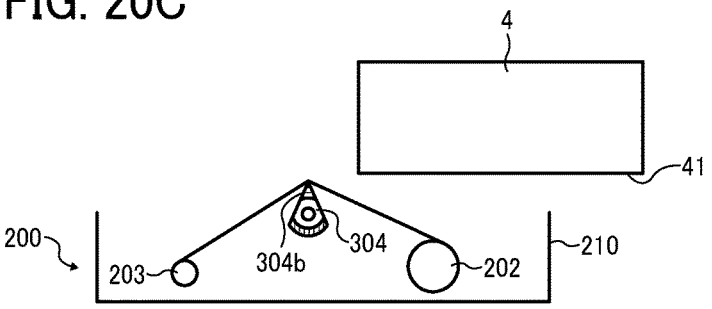

The moving member 210 is then stopped moving at a wiping end position illustrated in FIG. 20C.

In the first wiping operation, the pressing force of the web 201 against the surface of the nozzle plate 41 is relatively weak. Thus, as the first wiping operation is performed at the time of a regular maintenance operation (e.g., before, during, or after a printing operation), a liquid repelling film on the surface of the nozzle plate 41 can be less damaged.

In the second wiping operation, the pressing force of the web 201 against the surface of the nozzle plate 41 is relatively strong. Thus, as the second wiping operation is performed in a condition where the waste liquid transferred onto the surface of the nozzle plate 41 is fixedly adhered (e.g., under a high-temperature low-humidity condition), the waste liquid on the surface of the nozzle plate 41 can be reliably wiped off and removed.

As wiping operations are repeatedly performed, a liquid repelling film disposed on the surface of the nozzle plate 41 is damaged. As liquid repellency of the liquid repelling film is decreased, a defective discharge (e.g., curved injection) may occur. To suppress damage to the surface of the nozzle plate 41, the web 201 is pressed against the surface of a nozzle plate 41 with a roller or a presser having a soft surface.

On the other hand, as the web 201 is pressed against the surface of the nozzle plate 41 with a weak pressing force, the waste liquid that is fixedly adhered to the surface of the nozzle plate 41 cannot be wiped off.

In the present embodiment, the presser 304 has two pressing parts 304*a* and 304*b* different in pressing force. In a regular wiping operation, one of the pressing parts expressing a weaker pressing force is used. In a special wiping operation for removing a fixedly adhered waste liquid, the other one of the pressing parts having a stronger expressing a stronger pressing force is used.

Thus, the waste liquid on the surface of the nozzle plate 41 can be reliably removed while reducing damage to the head 4.

The liquid to be discharged by the liquid discharge apparatus is not limited to any particular substance so long as the viscosity and surface tension thereof do not prevent the liquid itself from being discharged from the head. In particular, liquids expressing a viscosity of 30 mPa·s or less under normal temperature and normal pressure, or under heating or cooling, are preferable. Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and 3D modeling material liquids.

As energy sources for discharging the liquid, piezoelectric actuators (e.g., laminated piezoelectric elements, thin-film piezoelectric elements), thermal actuators using electrothermal conversion elements such as heat elements, and electrostatic actuators formed of a vibration plate and a counter electrode may be used.

In the present disclosure, "liquid discharge unit" refers to a liquid discharge head integrated with functional components/mechanisms. The liquid discharge unit includes an aggregation of components related to liquid discharge. For example, the liquid discharge unit may include a combination of a liquid discharge head with at least one of a head tank, a carriage, a supply mechanism, a maintenance unit, and a main scanning moving mechanism.

When it is stated that a liquid discharge head and functional components/mechanisms are integrated with each other, it refers to a case in which the liquid discharge head and the functional components/mechanisms are secured to each other by means of fastening, bonding, or engaging, or another case in which one of the liquid discharge head and the functional components/mechanisms is movably supported by the other one of them. In addition, it also refers to a case in which the liquid discharge head and the functional components/mechanisms are detachably attached to each other.

Examples of the liquid discharge unit include a liquid discharge head integrated with a head tank. In this case, the liquid discharge head and the head tank may be connected to each other with a tube. Furthermore, a filter unit may be disposed between the head tank and the liquid discharge head.

Examples of the liquid discharge unit further include a liquid discharge head integrated with a carriage.

Examples of the liquid discharge unit further include a liquid discharge unit integrated with a scanning moving mechanism. In particular, the liquid discharge head is supported with a guide member included in the scanning moving mechanism. Examples of the liquid discharge unit further include a liquid discharge unit integrated with a carriage and a scanning moving mechanism.

Examples of the liquid discharge unit further include a liquid discharge head integrated with a carriage and a maintenance mechanism. In particular, the liquid discharge head is mounted on the carriage, and a cap member of the maintenance mechanism is secured to the carriage.

Examples of the liquid discharge unit further include a liquid discharge head integrated with a supply mechanism. In particular, a head tank or a flow path member is mounted on the liquid discharge head, and a tube is connected to the liquid discharge head. A liquid stored in a liquid container is supplied to the liquid discharge head via the tube.

Examples of the main scanning moving mechanism include a single guide member. Examples of the supply mechanism include a single tube or a single loading port.

In the present disclosure, "liquid discharge apparatus" refers to an apparatus including a liquid discharge head or a liquid discharge unit, configured to discharge a liquid by driving the liquid discharge head. Examples of the liquid discharge apparatus include an apparatus capable of discharging a liquid to a substance to which the liquid is adherable and another apparatus capable of discharging a liquid toward a gas or liquid.

The liquid discharge apparatus may further include units for feeding, conveying, or ejecting the substance to which the liquid is adherable, a preprocessing device, and/or a post-processing device.

Specific examples of the liquid discharge apparatus include an image forming apparatus that discharges an ink onto a sheet to form an image thereon, and a three-dimensional modeling apparatus that discharges a modeling liquid onto a powder lamination layer to model a three-dimensional modeled product.

The liquid discharge apparatus is not limited to an apparatus that visualizes meaningful images, such as texts and charts, with the discharged liquid. Examples of the liquid discharge apparatus also include an apparatus that forms meaningless patterns and another apparatus that models three-dimensional images.

The above-described "substance to which a liquid is adherable" refers to a substance to which a liquid is at least temporarily adherable, allowing the liquid to fix thereon or permeate after the adhesion. Specific examples of such substances include, but are not limited to, recording media (e.g., paper sheet, recording sheet, film, clothe), electronic components (e.g., electronic substrate, piezoelectric element), powder layers, organ models, and test cells.

The substance to which a liquid is adherable may be made of any material to which a liquid is at least temporarily adherable, such as paper, thread, fiber, cloth, laser, metal, plastic, glass, wood, and ceramic.

Examples of the liquid discharge apparatus further include an apparatus in which a liquid discharge head and a substance to which a liquid is adherable are movable relative to each other, but are not limited thereto. Specific examples of such an apparatus include a serial-type apparatus in which a liquid discharge head is movable and a line-type apparatus in which a liquid discharge head is unmovable.

Examples of the liquid discharge apparatus further include: a treatment liquid applying apparatus that discharges a treatment liquid onto a paper sheet to apply the treatment liquid to the surface of the paper sheet, for reforming the surface of the paper sheet; and an injection granulation apparatus that injects a composition liquid, in which a raw material is dispersed in a solution, through a nozzle to granulate fine particle of the raw material.

In the present disclosure, "image forming", "recording", "printing", and "modeling" are treated as synonymous terms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head including a nozzle plate on which a nozzle is disposed, the nozzle being configured to discharge a liquid;

a cap configured to cap a surface of the nozzle plate; and a wiper configured to move relative to the nozzle plate to wipe the surface of the nozzle plate, wherein the surface of the nozzle plate has a cap contact region that is contactable with the cap, wherein the wiper is disposed to start wiping from a wiping start position on the surface of the nozzle plate, the wiping start position being disposed between both end parts of the cap contact region on the surface of the nozzle plate in a direction of wiping, and wherein the wiper is disposed to come into contact with the surface of the nozzle plate at the wiping start position and move in a first direction with the wiper contacting the surface of the nozzle plate to wipe the surface of the nozzle plate, and thereafter move in a second direction opposite the first direction with the wiper contacting the surface of the nozzle plate to wipe the surface of the nozzle plate.

2. The liquid discharge apparatus of claim 1, wherein the wiper is configured to come into contact with two separate positions within the cap contact region at the wiping start position.

3. The liquid discharge apparatus of claim 2, wherein the wiping start position is disposed between one of the end parts of the cap contact region and the nozzle in the direction of wiping.

4. The liquid discharge apparatus of claim 1, wherein a first wiping end position where the wiper ends moving in the first direction and a second wiping end position where the wiper ends moving in the second direction are both disposed outside the cap contact region in the direction of wiping.

5. The liquid discharge apparatus of claim 1, further comprising a moving member configured to move in the direction of wiping, wherein the wiper is mounted on the moving member so as to be movable relative to the moving member, and wherein the wiper is configured to come into contact with the surface of the nozzle plate and move relative to the moving member in the same direction as a direction of movement of the moving member, to wipe the surface of the nozzle plate.

6. The liquid discharge apparatus of claim 5, wherein the wiper is a belt-shaped wiper.

7. The liquid discharge apparatus of claim 5, further comprising an applicator configured to apply a cleaning liquid to the wiper.

8. The liquid discharge apparatus of claim 1, further comprising a moving member configured to move in the direction of wiping, wherein the wiper is mounted on the moving member so as to be movable relative to the moving member, and wherein the wiper is configured to come into contact with the surface of the nozzle plate and move relative to the moving member in an opposite direction to a direction of movement of the moving member, to wipe the surface of the nozzle plate.

9. The liquid discharge apparatus of claim 8, wherein the wiper is a belt-shaped wiper.

10. The liquid discharge apparatus of claim 8, further comprising an applicator configured to apply a cleaning liquid to wiper.

11. The liquid discharge apparatus according to claim 1, further comprising:

a presser configured to press the wiper against the surface of the nozzle plate, the presser including a first pressing part and a second pressing part each expressing different pressing forces.

12. The liquid discharge apparatus of claim 11, wherein the wiper is a belt-shaped wiper.

13. The liquid discharge apparatus of claim 11, wherein the second pressing part is smaller than the first pressing part in a contact area with the wiper.

14. The liquid discharge apparatus of claim 11, wherein the second pressing part is lower than the first pressing part in hardness.

15. The liquid discharge apparatus of claim 11, wherein the wiper is configured to move at a first speed or a second speed when the first pressing part or the second pressing part, respectively, is pressed against the wiper, and the second wiping speed is smaller than the first wiping speed.

* * * * *